US010258148B1

(12) United States Patent
Donner et al.

(10) Patent No.: US 10,258,148 B1
(45) Date of Patent: Apr. 16, 2019

(54) CONVERTIBLE SIT-TO-STAND DESK

(71) Applicant: Brunswick Corporation, Lake Forest, IL (US)

(72) Inventors: Matthew A. Donner, Andover, MN (US); Matthew P. Blum, Chicago, IL (US)

(73) Assignee: Brunswick Corporation, Mettawa, IL (US)

( * ) Notice: Subject to any disclaimer, the term of this patent is extended or adjusted under 35 U.S.C. 154(b) by 39 days.

(21) Appl. No.: 15/584,153

(22) Filed: May 2, 2017

(51) Int. Cl.

| | |
|---|---|
| ***A47B 9/02*** | (2006.01) |
| ***A47B 9/16*** | (2006.01) |
| ***A47B 9/14*** | (2006.01) |
| ***A47B 21/02*** | (2006.01) |
| ***A47B 17/02*** | (2006.01) |
| *A47B 9/00* | (2006.01) |

(52) U.S. Cl.
CPC ..... *A47B 9/16* (2013.01); *A47B 17/02* (2013.01); *A47B 9/02* (2013.01); *A47B 21/02* (2013.01); *A47B 2009/006* (2013.01)

(58) Field of Classification Search
CPC .... A47B 9/00; A47B 9/02; A47B 9/16; A47B 17/02; A47B 2009/006; A47B 21/02
USPC ..... 248/124.1, 164, 421, 588, 631; 108/145, 108/147, 150, 160; 312/312, 306
See application file for complete search history.

(56) References Cited

U.S. PATENT DOCUMENTS

| | | | | |
|---|---|---|---|---|
| 2,531,856 | A | 11/1950 | Marcouiller | |
| 2,922,685 | A | 1/1960 | Lappin et al. | |
| 3,140,894 | A | 7/1964 | Hicke | |
| 3,161,161 | A | 12/1964 | Reinke | |
| 3,494,662 | A | 2/1970 | Schaefer et al. | |
| 4,926,760 | A | 5/1990 | Sack | |
| 5,588,377 | A * | 12/1996 | Fahmian | A47B 9/00 108/145 |
| 5,649,493 | A | 7/1997 | Blume | |
| 6,974,185 | B2 | 12/2005 | Hsieh | |
| 7,640,869 | B2 | 1/2010 | Leng | |
| 8,016,305 | B2 | 9/2011 | Cheng | |
| 8,544,391 | B2 | 10/2013 | Knox et al. | |
| 8,936,306 | B2 | 1/2015 | Liu et al. | |
| 9,055,810 | B2 | 6/2015 | Flaherty | |
| 9,113,703 | B2 | 8/2015 | Flaherty | |
| 9,161,616 | B1 | 10/2015 | Arishenkoff et al. | |
| 9,326,598 | B1 | 5/2016 | West et al. | |
| 9,480,332 | B2 | 11/2016 | Han | |
| 9,554,644 | B2 | 1/2017 | Flaherty et al. | |
| 9,615,655 | B1 * | 4/2017 | Huang | A47B 9/16 |
| 9,625,929 | B2 * | 4/2017 | Wu | G05F 1/66 |
| 9,644,378 | B2 * | 5/2017 | Knox | E04G 1/22 |
| 9,681,746 | B1 * | 6/2017 | Chen | A47B 9/02 |

(Continued)

*Primary Examiner* — Tan Le
(74) *Attorney, Agent, or Firm* — Andrus Intellectual Property Law, LLP

(57) ABSTRACT

A convertible sit-to-stand desk has a desktop that is manually movable into and between a lowered position and a raised position, a base that is configured to support the desktop with respect to a supporting surface, and a supporting frame that supports the desktop with respect to the base. The supporting frame facilitates movement of the desktop into and between the lowered and raised positions. The supporting frame comprises first and second sub-frame assemblies disposed on opposite sides of the desktop, respectively.

5 Claims, 8 Drawing Sheets

(56) References Cited

U.S. PATENT DOCUMENTS

| | | | |
|---|---|---|---|
| 2016/0120300 | A1 | 5/2016 | Ergun et al. |
| 2016/0249737 | A1 | 9/2016 | Han |

* cited by examiner

CONVERTIBLE SIT-TO-STAND DESK

FIELD

The present disclosure relates to convertible furniture assemblies, and particularly to convertible sit-to-stand desks.

BACKGROUND

The following U.S. Patents are hereby incorporated herein by reference:

U.S. Pat. Nos. 2,922,685; 3,140,894; 3,161,161; and 3,494,662 and disclose convertible furniture assemblies.

SUMMARY

This Summary is provided to introduce a selection of concepts that are further described herein below in the Detailed Description. This Summary is not intended to identify key or essential features of the claimed subject matter, nor is it intended to be used as an aid in limiting scope of the claimed subject matter.

A convertible sit-to-stand desk comprises a desktop that is manually movable into and between a lowered position and a raised position, a base that is configured to support the desktop with respect to a supporting surface, and a supporting frame that supports the desktop with respect to the base, the supporting frame facilitating movement of the desktop into and between the lowered and raised positions. The supporting frame comprises first and second sub-frame assemblies disposed on opposite sides of the desktop, respectively. Each of the first and second sub-frame assemblies comprises first and second frame members that are connected together along a pivot axis such that the first and second frame members pivot towards a horizontal, parallel alignment with each other when the desktop is moved into the lowered position and such that the first and second frame members pivot towards a transverse alignment with each other when the desktop is moved into the raised position. The first frame member comprises an upper end that is connected to the desktop at a desktop stationary pivot connection and a lower end that is connected to the base at a base movable pivot connection that is movable with respect to the base as the desktop is moved into and between the lowered position and raised position. The second frame member comprises an upper end that is connected to the desktop at a desktop movable pivot connection that is movable with respect to the desktop when the desktop is moved into and between the raised position and the lowered position and a lower end that is connected to the base at a base stationary pivot connection. A manual locking mechanism locks the desktop in each of a plurality of positions of the desktop in and between the raised position and the lowered position. The locking mechanism comprises a pivot bar device that pivots into and out of engagement with the desktop movable pivot connection to thereby lock and unlock the desktop movable pivot connection in one of a plurality of positions corresponding to the plurality of positions of the desktop in and between the raised position and the lowered position.

DETAILED DESCRIPTION OF THE DRAWINGS

Figure 1:
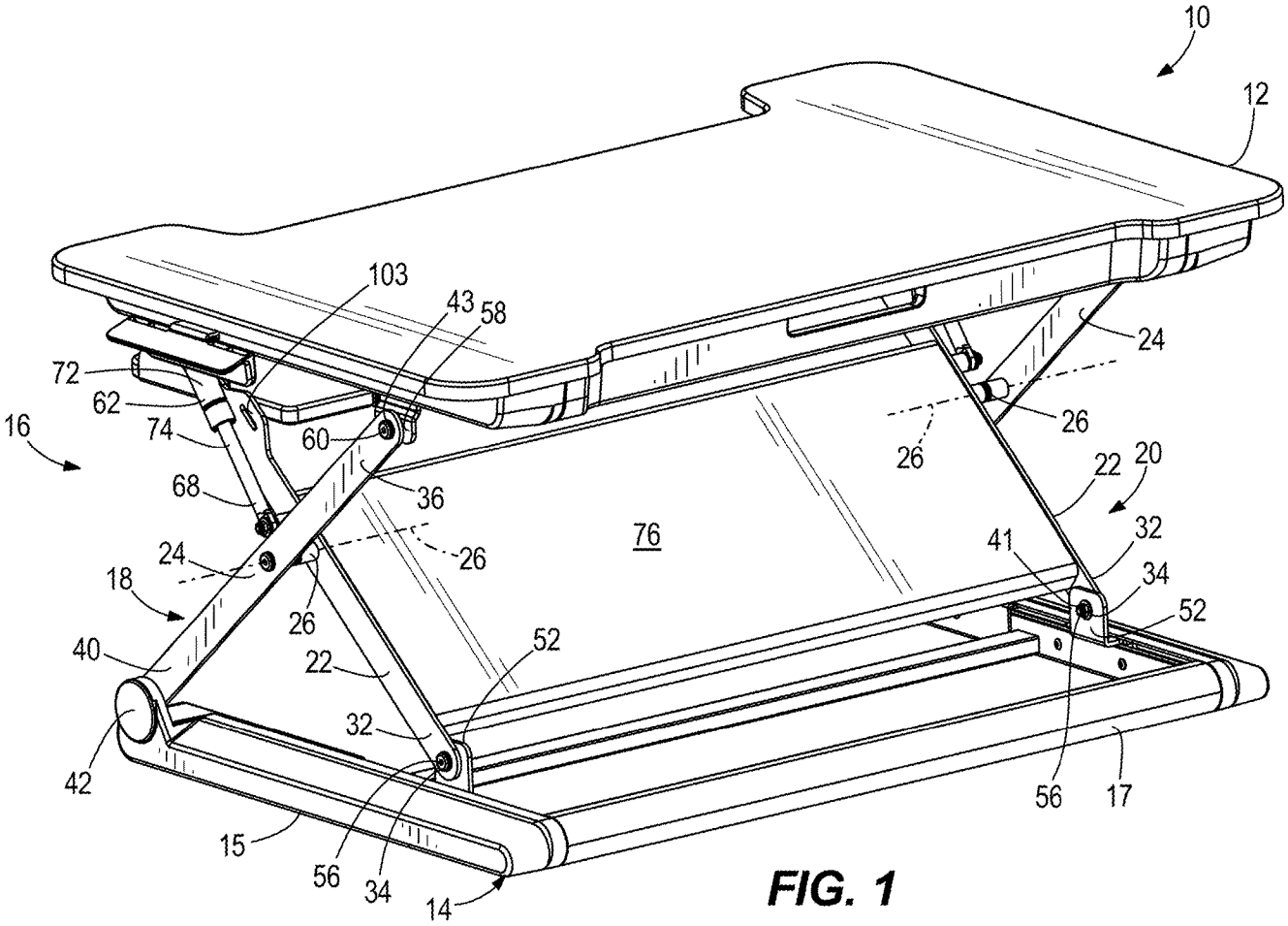
FIG. 1 is a front perspective view of a convertible sit-to-stand desk in a raised position.
Figure 2:
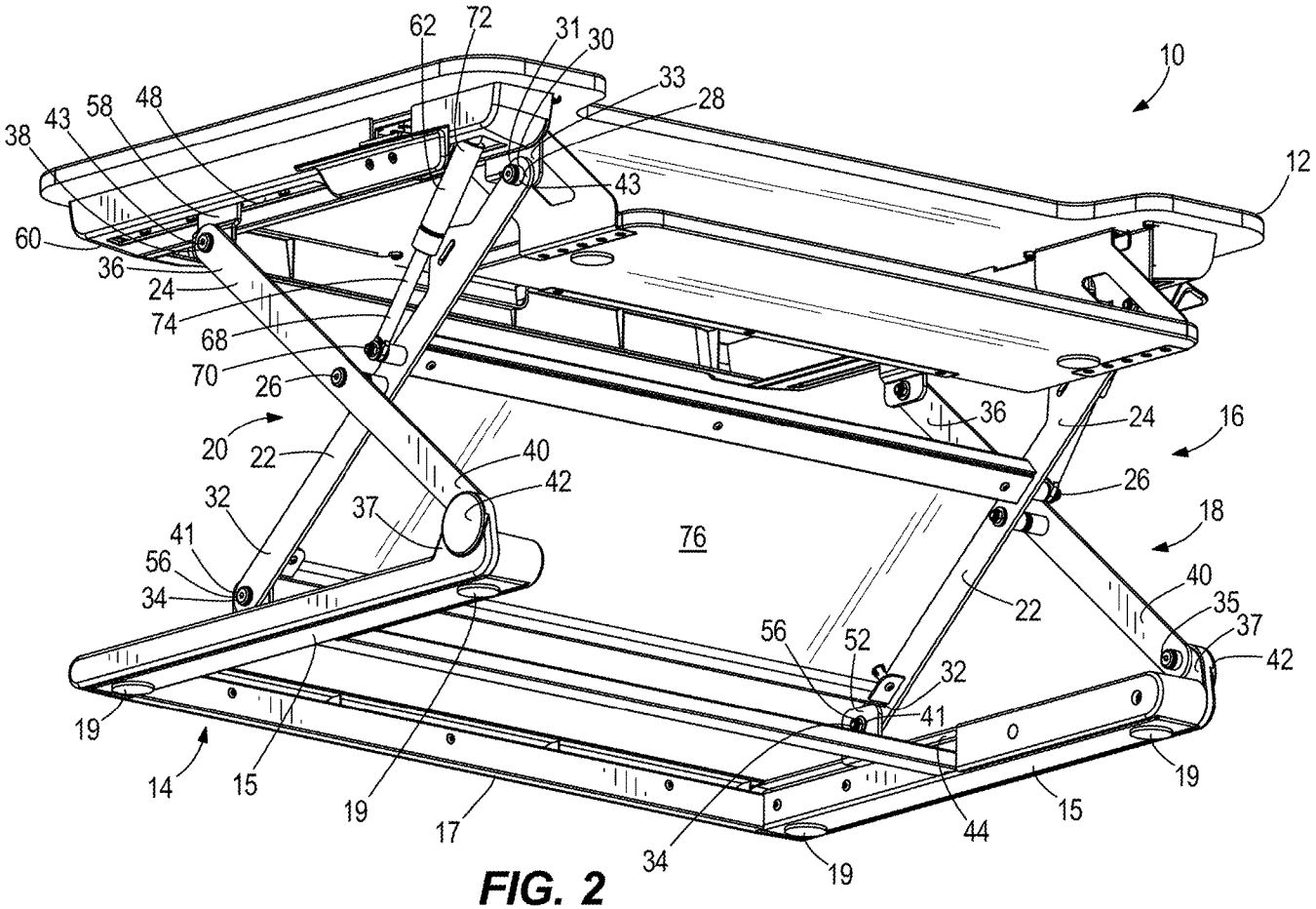
FIG. 2 is a rear perspective view of a convertible sit-to-stand desk in the raised position.
Figure 5:
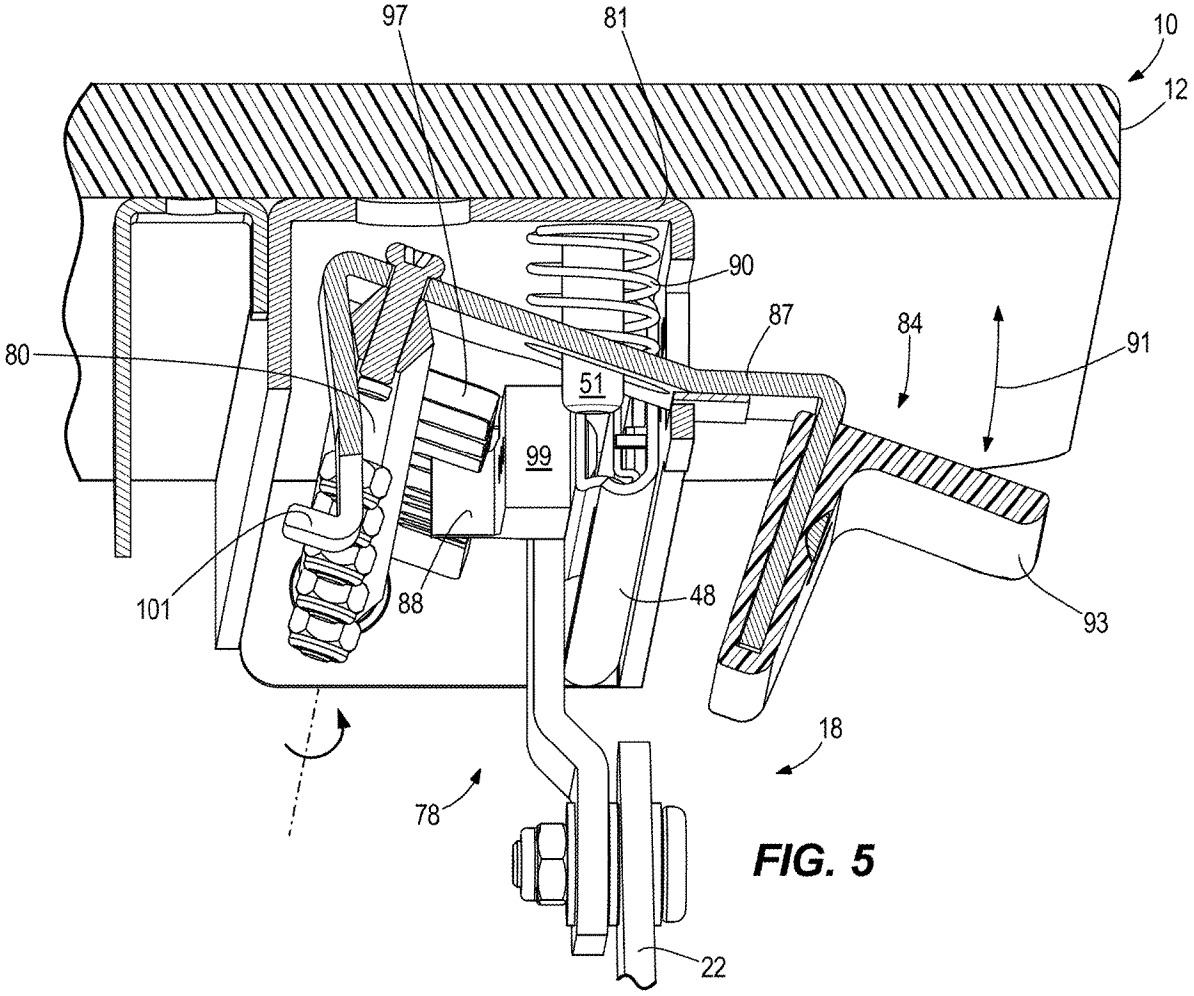
FIG. 5 is a view of section 5-5, taken in FIG. 3.
Figure 6:
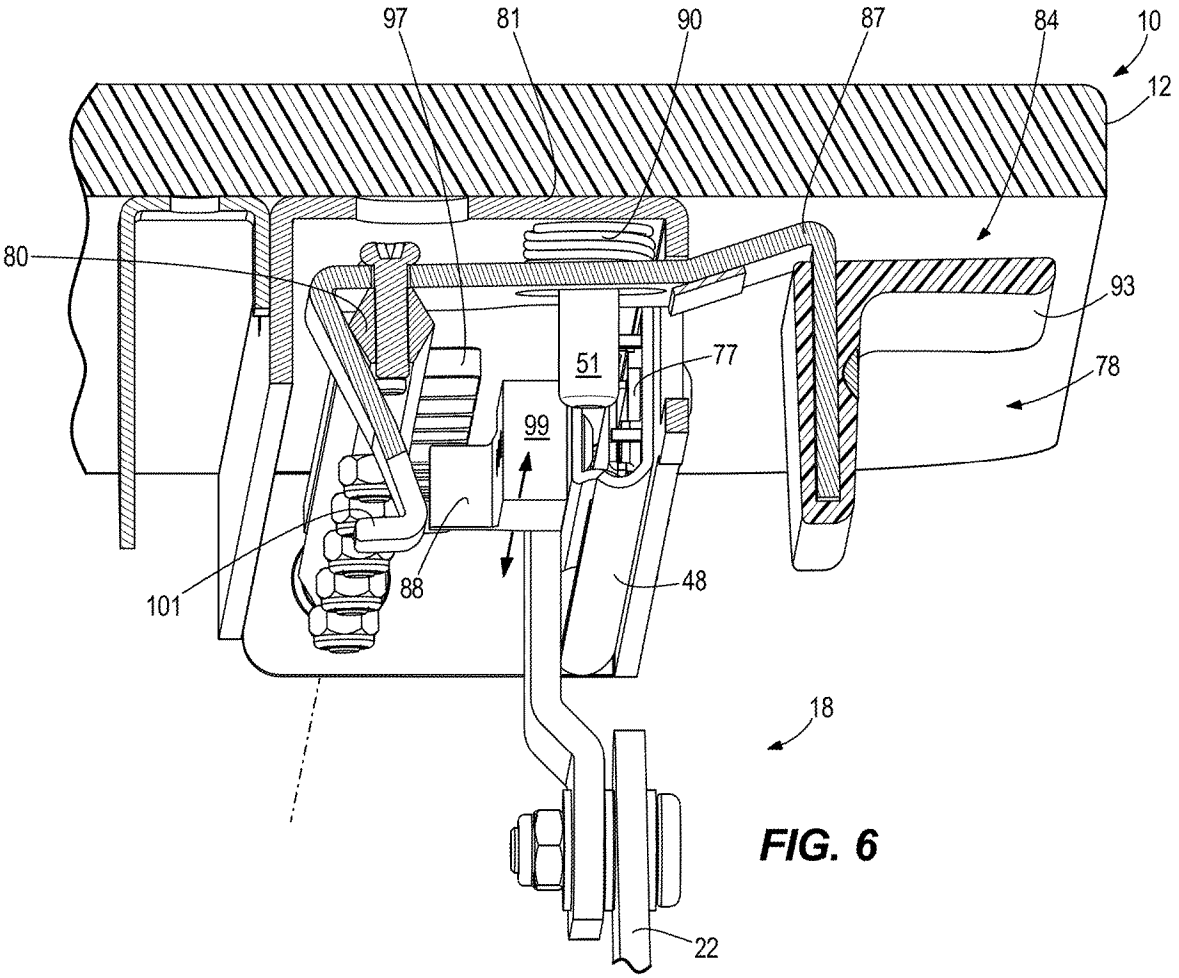
FIG. 6 is a view like FIG. 5, showing movement of a locking mechanism that locks the desktop in position.
Figure 7:
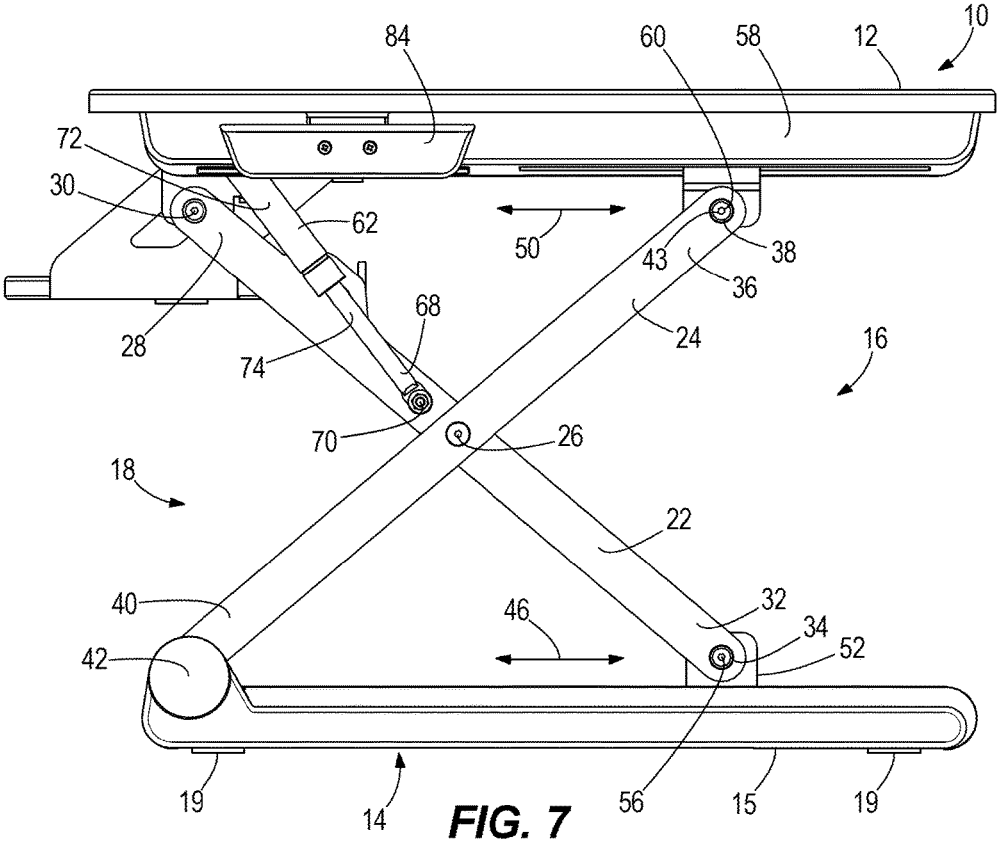
FIG. 7 is a side view of the convertible sit-to-stand desk in the raised position.
Figure 8:
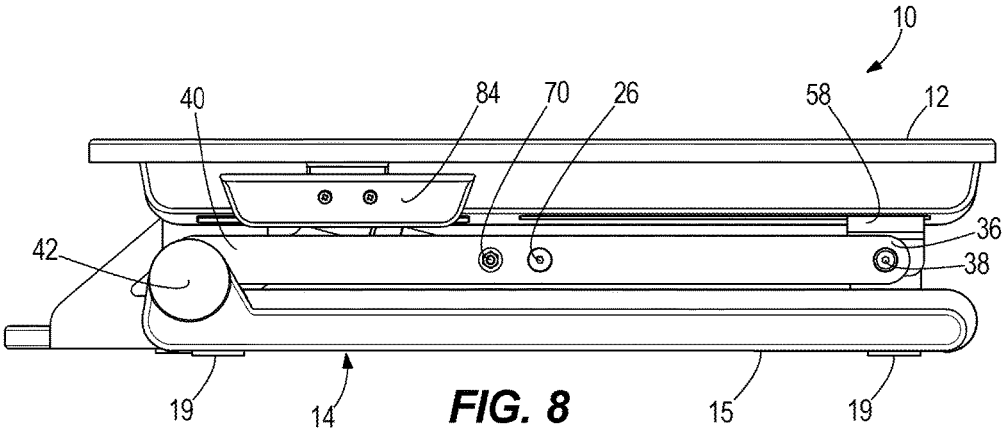
FIG. 8 is a side view of the convertible sit-to-stand desk in a lowered position.
Figure 9:
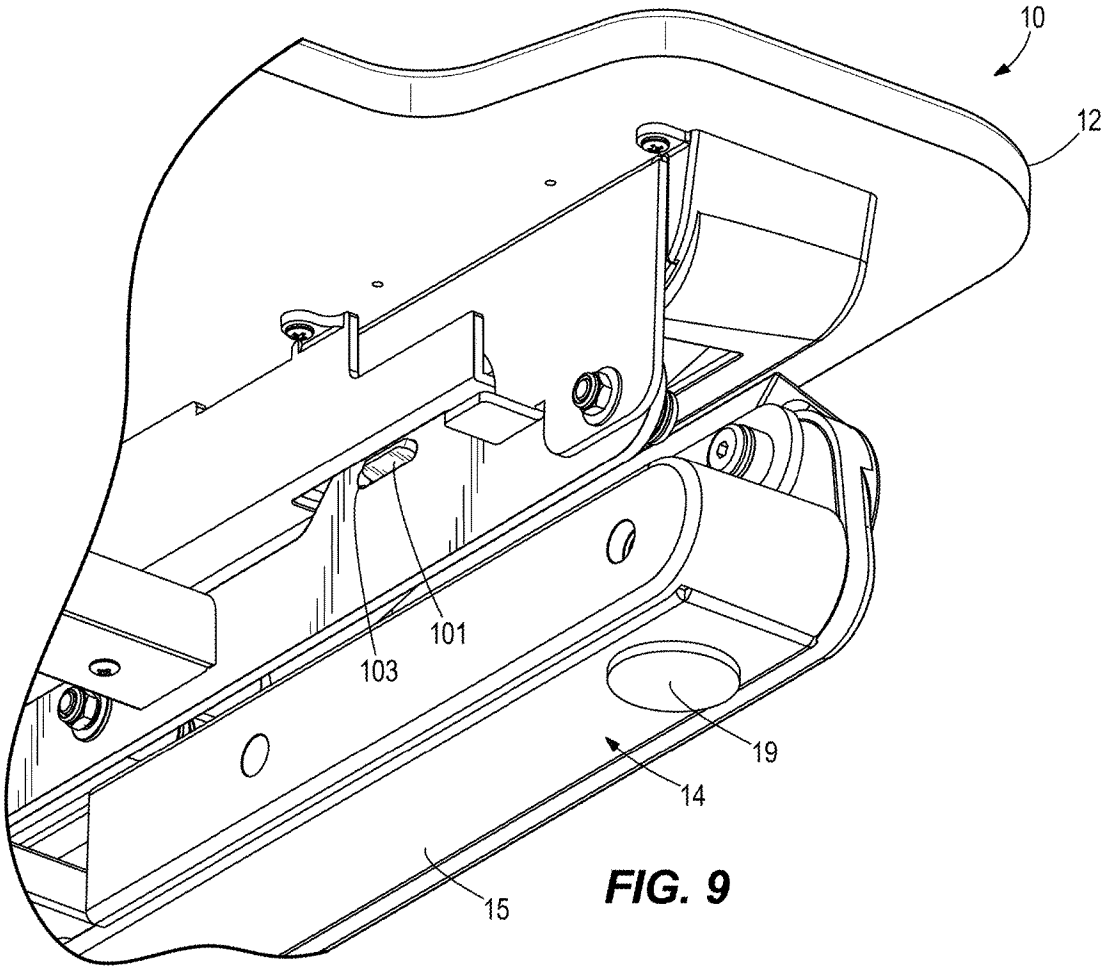
FIG. 9 is a partial view of the convertible sit-to-stand desk in the lowered position.

FIGS. 1-9 depict a convertible sit-to-stand desk 10 according to the present disclosure. The sit-to-stand desk 10 has a desktop 12 that is manually moveable into and between a raised position and a lowered position, as further described herein below. FIGS. 1, 2 and 7 depict the sit-to-stand desk 10 in the raised position. FIGS. 8 and 9 depict the sit-to-stand desk 10 in the lowered position. Referring generally to FIGS. 1 and 2, a base 14 is configured to support the desktop 12 with respect to an underlying supporting surface. The configuration of the base 14 can vary from what is shown. In the illustrated example, the base 14 includes a pair of side rails 15 and a front rail 17 that extends between the side rails 15. A plurality of scratch resistive foot pads 19 is disposed on the bottom surface of the side rails 15 to prevent the sit-to-stand desk 10 from scratching the supporting surface, which can for example be a desktop of a stationary desk or table.

A movable supporting frame 16 supports the desktop 12 with respect to the base 14. In particular, the supporting frame 16 facilitates movement of the desktop 12 into and between the above-noted lowered and raised positions. The supporting frame 16 includes first and second sub-frame assemblies 18, 20 that are disposed on opposite sides of the desktop 12, respectively. The first and second sub-frame assemblies 18, 20 are similarly constructed (i.e. mirror images of each other) and thus the detailed description provided herein below regarding the first sub-frame assembly 18 equally applies to the second sub-frame assembly 20.

Each of the first and second sub-frame assemblies 18, 20 includes first and second frame members 22, 24 that are connected together along a pivot axis 26 such that the first and second frame members 22, 24 are pivotable towards a horizontal, parallel alignment which each other (see FIGS. 8 and 9) when the desktop 12 is moved into the lowered position and such that the first and second frame members 22, 24 are pivotable towards a transverse alignment with each other (see FIGS. 1, 2, 4 and 7) when the desktop 12 is moved into the raised position.

Referring to FIG. 2, the first frame member 22 has an upper end 28 that is connected to the desktop 12 at a fixed, desktop stationary pivot connection 30 and a lower end 32 that is connected to the base 14 at a base movable pivot connection 34, which is movable (slide-able) with respect to the base 14 as the desktop 12 is moved into and between the raised position and the lowered position. The second frame member 24 includes an upper end 36 that is connected to the desktop 12 at a desktop movable pivot connection 38 which is movable (slide-able) with respect to the desktop 12 when the desktop 12 is moved into and between the raised position and the lowered position, and a lower end 40 that is connected to the base 14 at a fixed, base stationary pivot connection 42.

Figure 4:
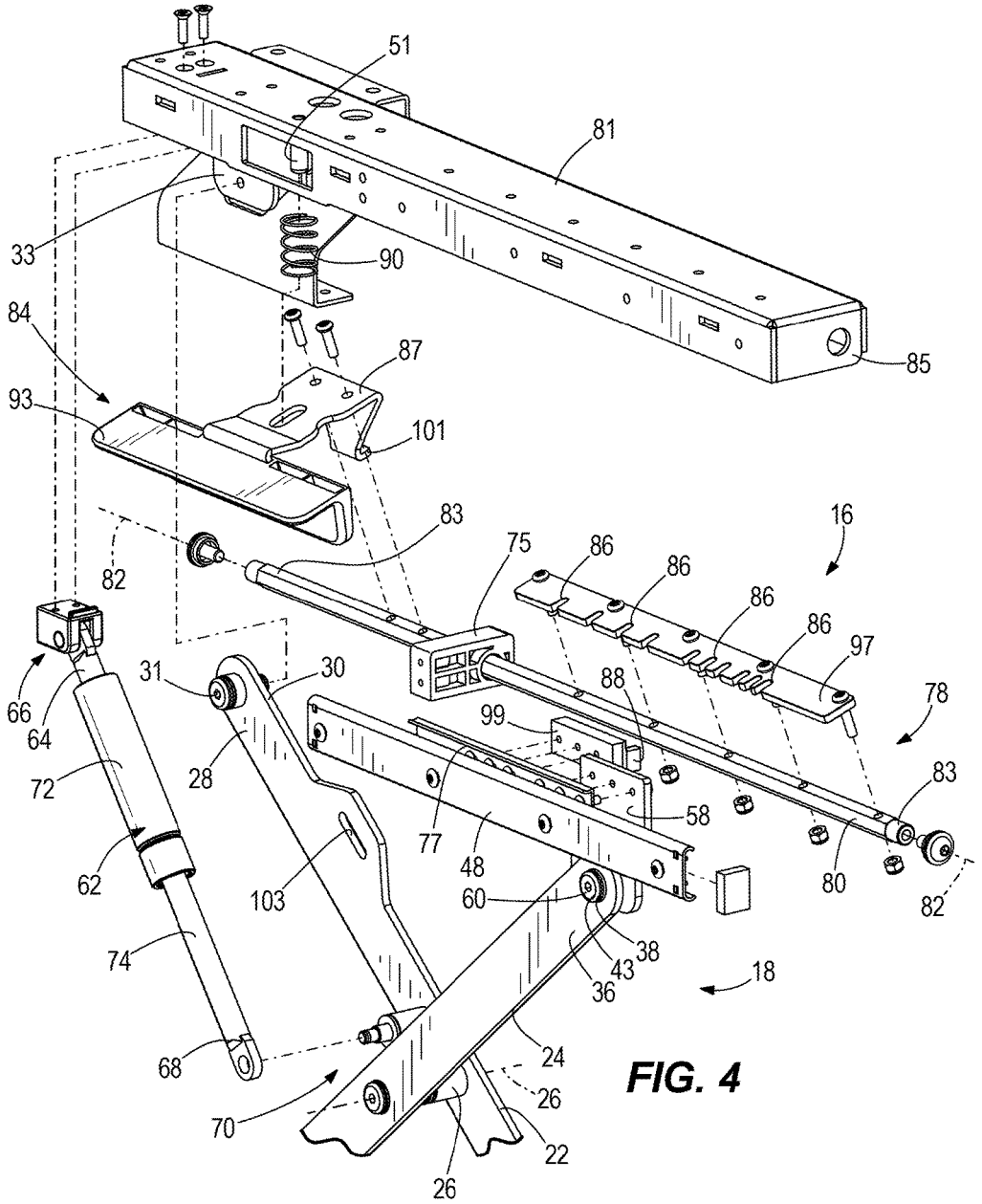
FIG. 4 is an exploded view of the sub-frame assembly.

Referring to FIGS. 2 and 4, a desktop stationary pivot connection 30 is provided by a bolt 31 that extends through holes in the upper end 28 of the first frame member 22 and a bracket 33 extending downwardly from the desktop 12. Referring to FIG. 2, the base stationary pivot connection 42 is provided by a bolt 35 that extends through holes in the lower end 40 of the second frame member 24 and a bracket 37 that extends upwardly from the base 14. Thus, the desktop stationary pivot connection 30 and the base stationary pivot connection 42 remain stationary with respect to the desktop 12 and base 14, respectively, as the desktop 12 is moved into the lowered and raised positions, as further described herein below. The configuration of the desktop stationary pivot connection 30 and base stationary pivot connection 42 can vary from what is shown.

Figure 3:
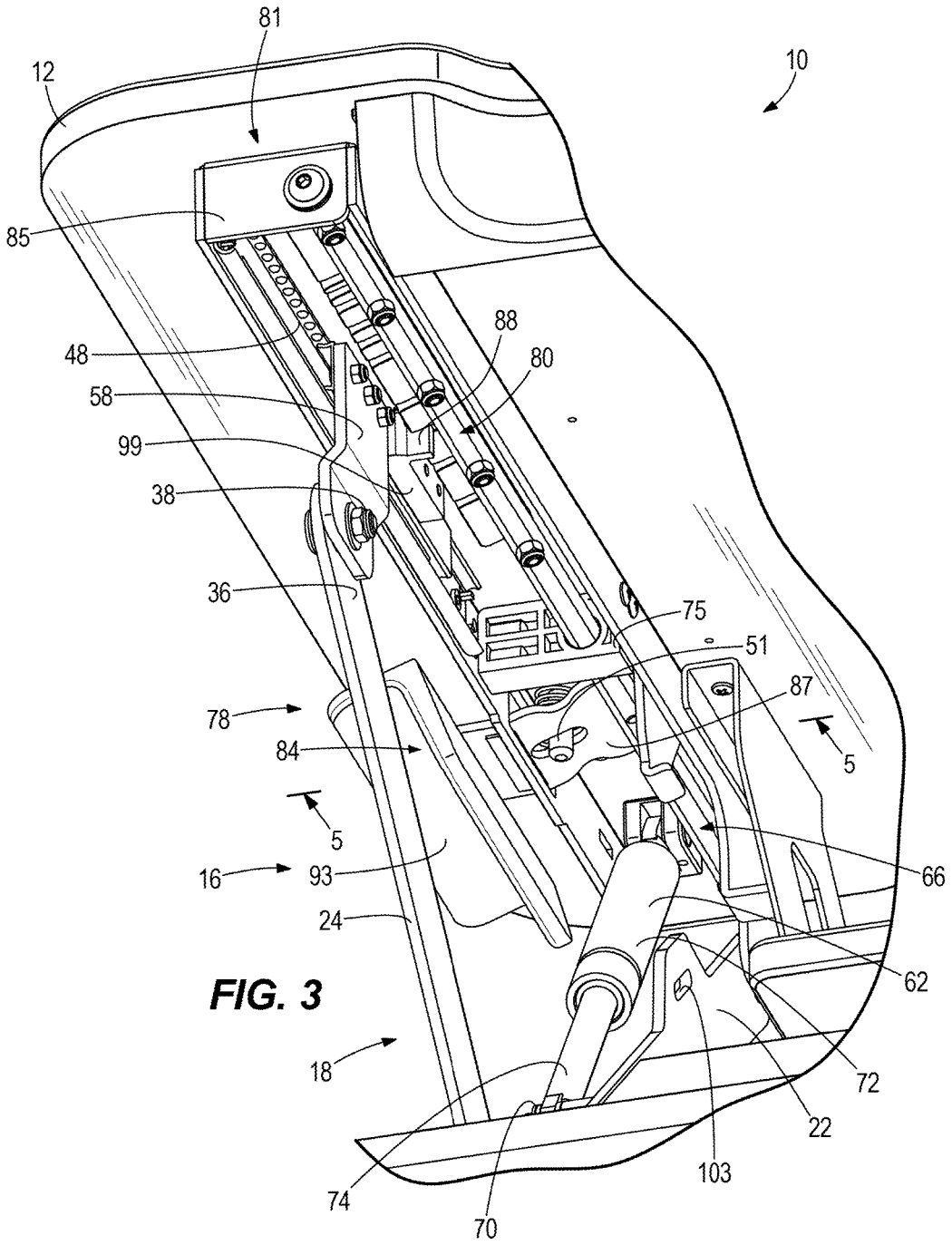
FIG. 3 is a view looking up at a portion of a supporting frame for the desk, particularly a sub-frame assembly that facilitates movement of the desktop.

Referring to FIG. 2, a lower track 44 is disposed on the side rail 15 and retains the lower end 32 of the first frame member with respect to the base 14 such that the lower end 32 of the first frame member 22 is slide-able back and forth with respect to the base 14 as the desktop 12 is moved into and between the raised position and lowered position. See arrows 46 in FIG. 7. Referring to FIGS. 2, 3 and 4, an upper track 48 retains the upper end 36 of the second frame member 24 with respect to the desktop 12 such that the upper end 36 of the second frame member 24 is slide-able back and forth with respect to the desktop 12 as the desktop 12 is moved into and between the raised position and lowered position. See arrows 50 in FIG. 7.

Referring to FIGS. 2 and 7, the base movable pivot connection 34 includes a lower bracket 52 that is engaged with a slider (not shown, but described further herein below) that is linearly slide-able along the lower track 44. The lower end 32 of the first frame member 22 is connected to the lower bracket 52 at a pivot point 56 that is provided by a bolt 41 that extends through holes in the lower end 32 of the first frame member 22 and the lower bracket 52, which extends upwardly from the lower track 44. Thus, the pivot point 56 is spaced apart from the lower track 44 and the lower end 32 of the first frame member 22 is disposed above the lower track 44. Referring to FIGS. 2 and 7, the desktop movable pivot connection 38 includes an upper bracket 58 that is engaged with a slider 77 (described further herein below) that is linearly slide-able along the upper track 48. The upper end 36 of the second frame member 24 is connected to the upper bracket 58 at a pivot point 60 that is provided by a bolt 43 that extends through holes in the upper end 36 of the second frame member 24 and the upper bracket 58, which extends from the upper track 48. Thus, the pivot point 60 is spaced apart from the upper track 48 and the upper end 28 of the second frame member 24 is disposed below the upper track 48.

Referring to FIGS. 2, 4 and 7, a conventional gas spring 62 is configured to assist movement of the desktop 12 into and out of the lowered and raised positions. The gas spring 62 has a first end 64 coupled to the desktop 12 at a pivot joint 66 and a second end 68 coupled to the first frame member 22 at a pivot joint 70. The gas spring 62 includes a cylinder 72 and piston-rod 74 that is reciprocate-able into and out of the cylinder 72 as the desktop 12 is manually moved into and between the lowered and raised positions. The cylinder 72 contains pressurized air and internal air passages (not shown), which facilitate movement of the piston-rod 74, all as is conventional, to thereby assist movement of the desktop 12. The gas spring 62 is configured to assist movement of the desktop 12 into the raised position and prevent the desktop 12 from freely falling into the lowered position. Gas springs are known in the art and thus the gas spring 62 is not further described herein.

Referring to FIGS. 1 and 2, a privacy shield 76 is coupled to and extends between the first and second sub-frame assemblies 18, 20. In particular, the privacy shield 76 is attached to the first frame members 22 of the opposing first and second sub-frame assemblies 18, 20. The privacy shield 76 advantageously blocks view of an operator's lower torso while sitting or standing at the sit-to-stand desk 10. The privacy shield 76 moves along with the respective first and second sub-frame assemblies 18, 20 during movement of the desktop 12 into and between the lowered and raised positions, and thus is pivotable along with the first frame members 22 into the above-noted horizontal and transverse orientations.

Referring to FIGS. 3-6, a manual locking mechanism 78 is configured to lock the desktop 12 in any one of a plurality of positions in and between lowered and raised positions shown in the figures. The manual locking mechanism 78 includes a pivot bar device 80 that is retained in a base housing 81 on the bottom side of the desktop 12. The pivot bar device 80 is elongated and has opposing ends 83 that are journaled in end walls 85 of the base housing 81. The pivot bar device 80 is also journaled through an intermediate bearing block 75 attached to the base housing 81, which further supports pivoting (rotation) of the pivot bar device 80 about its own axis 82.

Referring to FIGS. 5 and 6, the pivot bar device 80 pivots (i.e. rotates about its own axis 82) into and out of engagement with the desktop movable pivot connection 38 to lock and unlock the desktop movable pivot connection 38 in one of a plurality of positions corresponding to the noted positions of the desktop 12 in and between the lowered and raised positions. More specifically, the pivot bar device 80 extends parallel to and along side of the upper track 48 and pivots about its own axis 82 when the locking mechanism 78 is manually actuated. A handle 84 is connected to the pivot bar device 80 by an angle bracket 87. Manually grasping the handle 84 and moving the handle 84 towards the bottom surface of the desktop 12 (see arrow 91 in FIG. 5) causes the pivot bar device 80 to pivot about its own axis 82 (counter-clockwise in FIG. 5). The handle 84 has a free end 93 that extends generally parallel to the desktop 12 so that the operator can manually grasp the edge of the desktop 12 and the free end 93 at the same time and clamp the free end 93 upwardly against the bottom surface of the desktop 12, as shown in FIG. 6 in the direction of arrow 91.

Referring to FIG. 4, the pivot bar device 80 includes a flange member 97 having a plurality of locking recesses 86 formed therein. A locking tab 88 extends from a mounting base 99 attached to the desktop movable pivot connection 38, for example to the slider 77, which slides in the upper track 48, thus facilitating linear sliding movement of the desktop movable pivot connection 38. A similar slider is not shown but is provided in the lower track 44 as part of the base movable pivot connection 34. The locking recesses 86 are configured to engage with the locking tab 88 on the desktop movable pivot connection 38 so as to retain the desktop movable pivot connection 38 in place with respect to the pivot bar device 80 and thus with respect to the desktop 12.

Actuation of the locking mechanism 78 via the handle 84 thus pivots the pivot bar device 80 so that the locking recesses 86 are moved out of engagement with the locking tab 88 (see FIG. 6), thereby allowing free sliding movement of the desktop movable pivot connection 38 along the upper track 48. The locking recesses 86 are moved upwardly into a space between the locking tab 88 and the lower surface of the desktop 12. Thus manually grasping the handle 84 frees the desktop movable pivot connection 38 for movement and allows manual movement of the desktop 12 into and between the lowered and raised position, as assisted by the gas spring 62.

Referring to FIGS. 4-6, a compression spring 90 spring-loads and thus causes locking of the locking mechanism 78 when the handle 84 is released. The spring 90 is disposed on pin 51 that extends from the base housing 81 and through a hole in the angle bracket 87. The spring 90 is compressed between the angle bracket 87 and the base housing 81 when the handle 84 is clamped towards the bottom surface of the desktop 12. When the handle 84 is manually released, the natural resiliency of the spring 90 pushes the angle bracket 87 away from the desktop 12 and thus causes the pivot bar device 80 to rotate about its axis 82 (clockwise in FIGS. 5 and 6), thereby pivoting the locking recesses 86 are pivoted into engagement with the locking tab 88 (see FIG. 5). Thus manually releasing the handle 84 locks the movable pivot connection 38 in place and retains the desktop 12 at a height determined by the particular locking recess 86 in which the locking tab 88 is retained.

The angle bracket 87 further includes a hook end 101 that engages with a catch aperture 103 in the first frame member 22 to securely retain the desktop in the lowered position shown in FIGS. 8 and 9. Manual actuation of the handle 84, as described above, pivots the angle bracket 87 and thus disengages the hook end 101 with the catch aperture 103 and allows the desktop 12 to be moved upwardly towards and into the raised position.

In the present description, certain terms have been used for brevity, clearness and understanding. No unnecessary limitations are to be implied therefrom beyond the requirement of the prior art because such terms are used for descriptive purposes only and are intended to be broadly construed. The different systems and methods described herein may be used alone or in combination with other systems and methods. Various equivalents, alternatives and modifications are possible within the scope of the appended claims.

What is claimed is:

1. A convertible sit-to-stand desk, comprising:

a desktop that is manually movable into and between a lowered position and a raised position;

a base that supports the desktop with respect to a supporting surface; and a supporting frame that supports the desktop with respect to the base, the supporting frame facilitating movement of the desktop into and between the lowered and raised positions;

wherein the supporting frame comprises first and second sub-frame assemblies disposed on opposite sides of the desktop, respectively;

wherein each of the first and second sub-frame assemblies comprises first and second frame members that are connected together along a pivot axis such that the first and second frame members pivot towards a horizontal, parallel alignment with each other when the desktop is moved into the lowered position and such that the first and second frame members pivot towards a transverse alignment with each other when the desktop is moved into the raised position;

wherein the first frame member comprises an upper end that is connected to the desktop at a desktop stationary pivot connection, and a lower end that is connected to the base at a base movable pivot connection that is movable with respect to the base as the desktop is moved into and between the lowered position and raised position; and wherein the second frame member comprises an upper end that is connected to the desktop at a desktop movable pivot connection that is movable with respect to the desktop when the desktop is moved into and between the raised position and the lowered position, and a lower end that is connected to the base at a base stationary pivot connection;

a lower track that retains the lower end of the first frame member with respect to the base, such that the lower end of the first frame member is slide-able back and forth with respect to the base as the desktop is moved into and between the lowered position and raised position;

an upper track that retains the upper end of the second frame member with respect to the desktop, such that the upper end of the second frame member is slide-able back and forth with respect to the desktop as the desktop is moved into and between the lowered position and raised position;

a manual locking mechanism that locks the desktop in each of a plurality of positions of the desktop in and between the raised position and the lowered position;

a handle that manually actuates the manual locking mechanism to lock and unlock the desktop into and out of each of the plurality of positions;

wherein the manual locking mechanism comprises a pivot bar device that pivots into and out of engagement with the desktop movable pivot connection to lock and unlock the desktop movable pivot connection in one of a plurality of positions corresponding to the plurality of positions of the desktop in and between the raised position and the lowered position;

wherein the pivot bar device extends parallel to the upper track and pivots about a pivot bar device axis when the locking mechanism is actuated;

wherein the pivot bar device comprises a plurality of locking recesses that are each configured to engage with a locking tab on the desktop movable pivot connection so as to retain the desktop movable pivot connection in place with respect to the pivot bar device;

wherein actuation of the manual locking mechanism pivots the pivot bar device so that the locking recesses are pivoted out of engagement with the locking tab, thereby allowing free movement of the desktop movable pivot connection along the upper track;

a spring that biases the pivot bar device so that the locking recesses are pivoted into engagement with the locking tab;

wherein the handle is coupled to the pivot bar device by a handle bracket, and wherein the spring acts on the handle bracket to thereby bias the handle and pivot bar device towards a position wherein the locking recesses are pivoted into engagement with the locking tab; and a gas spring that assists movement of the desktop from the lowered position to the raised position.

2. The convertible sit-to-stand desk according to claim 1, wherein the base movable pivot connection comprises a lower bracket that is engaged with and slide-able along the lower track, and wherein the lower end of the first frame member is connected to the lower bracket at a pivot point that is spaced apart from the lower track so that the lower end of the first frame member is disposed above the lower track.

3. The convertible sit-to-stand desk according to claim 1, wherein the desktop movable pivot connection comprises a upper bracket that is engaged with and slide-able along the upper track, and wherein the upper end of the second frame member is connected to the upper bracket at a pivot point that is spaced apart from the upper track so that the upper end of the second frame member is disposed below the upper track.

4. The convertible sit-to-stand desk according to claim 1, wherein the gas spring has a first end coupled to the desktop and a second end coupled to the first frame member.

5. The convertible sit-to-stand desk according to claim 1, further comprising a privacy shield that is coupled to and extends between the first and second sub-frame assemblies.

* * * * *